United States Patent [19]

Glatz

[11] 4,435,978

[45] Mar. 13, 1984

[54] HOT WIRE ANEMOMETER FLOW METER

[76] Inventor: John J. Glatz, 24351 Spartan, Mission Viejo, Calif. 92691

[21] Appl. No.: 415,261

[22] Filed: Sep. 7, 1982

[51] Int. Cl.[3] ..... E21B 47/00; G01F 1/68

[52] U.S. Cl. ..... 73/155; 73/198; 73/204; 166/250

[58] Field of Search ..... 73/155, 198, 204; 166/250

[56] References Cited

U.S. PATENT DOCUMENTS 3,934,467 1/1976 Nicolas ..... 73/155

*Primary Examiner*—Howard A. Birmiel

*Attorney, Agent, or Firm*—Hubbard & Stetina

[57] ABSTRACT

A hot wire anemometer flow meter device is disclosed which is particularly adapted to be inserted down hole in a gas or oil well line or casing to accurately measure fluid flow through the line. The device comprises an elongate member formed of a plurality of tubing segments or modules interconnected in an end-to-end axial orientation. The segments located adjacent opposite ends of the elongate member include a plurality of arm struts, extensible radially outward to selectively anchor and axially register the device in a desired location within the line. Each of the arm struts mount one or more hot wire anemometers which yield a varying current signal in response to fluid flow across the same. A temperature gauge, pressure gauge, directional indicator, phase gauge, and battery source are additionally provided which enables the current signals obtained from the anemometers to be calibrated and integrated mathematically to yield accurate flow measurement results irrespective of laminar or turbulent flow conditions within the line.

14 Claims, 5 Drawing Figures

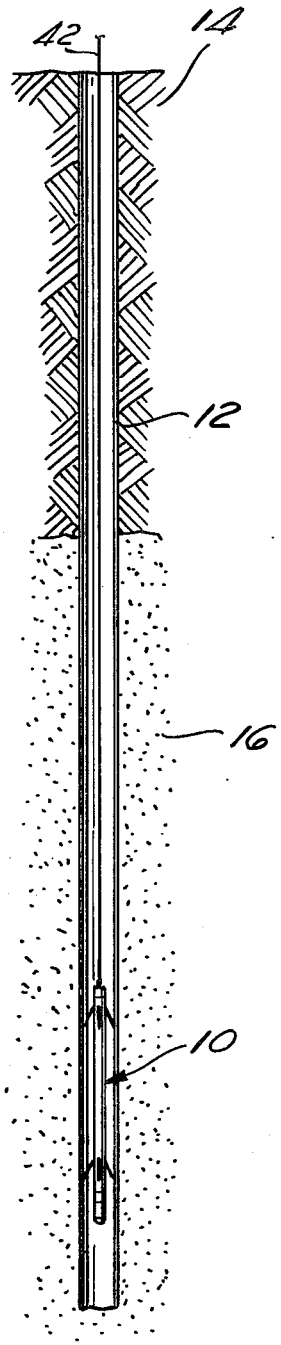
Fig. 1
Fig. 2
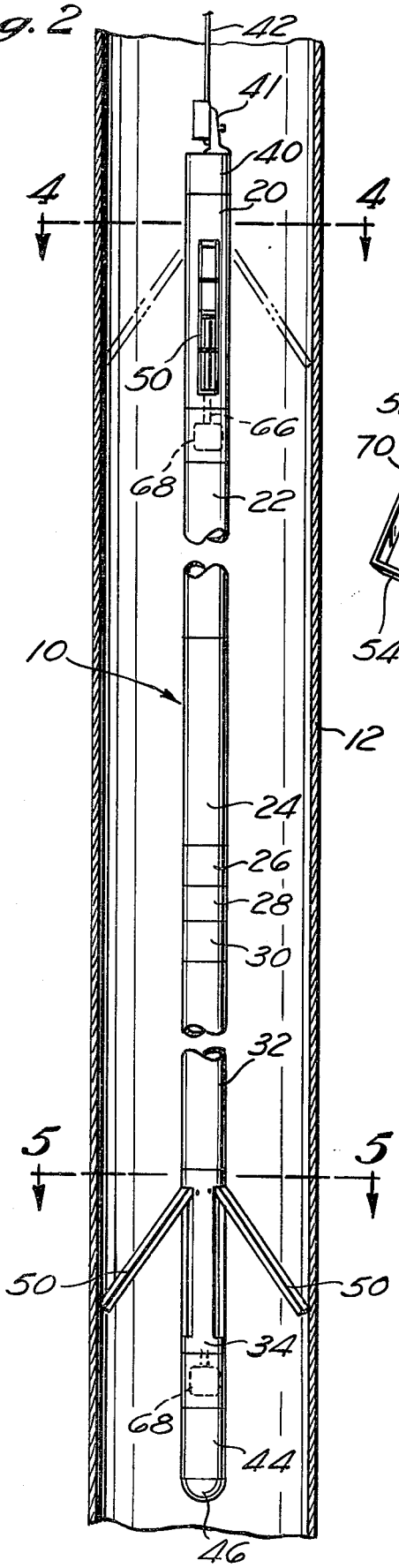
Fig. 3
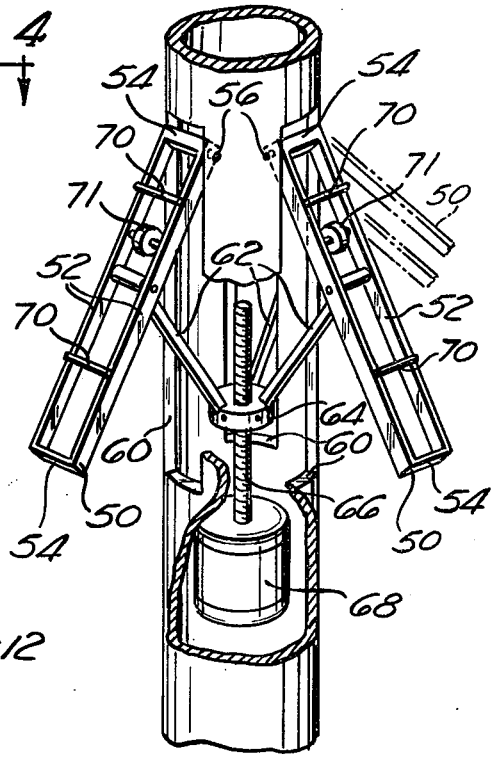
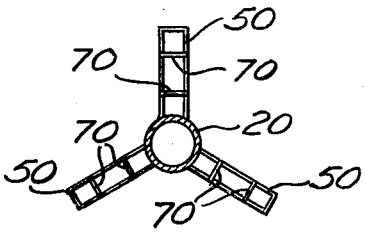
Fig. 5
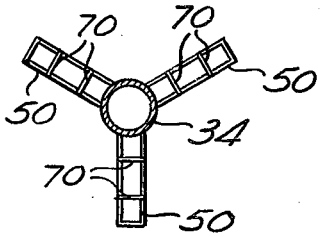
Fig. 4

HOT WIRE ANEMOMETER FLOW METER

BACKGROUND OF THE PRESENT INVENTION

The present invention relates to flow measuring devices and, more particularly, to a hot wire anemometer flow meter adapted to measure fluid flow within a conduit such as that utilized in downhole gas, oil well, or geothermal applications.

As is well known in the oil and gas industry, it is usually advantageous and often necessary to measure the flow in an oil or gas line to determine or forecast well production. Heretofore, the most common practice in the industry was to insert a turbine flow meter down hole which upon rotational movement of the turbine rotor, generated an electrical signal representing the flow through the well. Although such prior art turbine flow meters have proven generally effective in their intended application, they possess inherent deficiencies which have detracted from their overall effectiveness in the trade.

Foremost of these deficiencies has been the inability of the prior art turbine flow meter devices to provide accurate flow measurements in turbulent flow or combination laminar/turbulent flow conditions. Further, the prior art turbine flow meters have typically yielded inaccurate measurement results in two phase (i.e. water and soil) or three phase (i.e. water or oil and gas) flow conditions. In addition, the operation of the turbine flow meters is dependent upon a generally vertical or axial orientation within the line which has rendered their use inappropriate for many of the more modern well applications, which utilize angularly extending well drilling techniques. Additionally, the prior art turbine flow meter devices have typically been incapable of being disposed down hole for extended periods of time to record long term changes in the flow within the well.

Hence, there exists a substantial need in the art for an improved down hole measuring device which provides both flow speed and direction measurements, is accurate in both turbulent and/or laminar flow conditions, can be utilized in singular, double, or triple phase flow applications, and is not dependent upon orientation within the flow line.

SUMMARY OF THE PRESENT INVENTION

The present invention specifically addresses and alleviates the above-referenced deficiencies associated in the prior art by providing a hot wire anemometer flow meter device which is particularly adapted to be inserted down hole in a gas or oil well line to accurately measure the flow through the line in both laminar and turbulent flow applications with either single, dual, or triple phase flow conditions.

More particularly, the present invention comprises an elongate member formed of a plurality of tubing segments interconnected in an end-to-end orientation. The tubing segments located adjacent opposite ends of the elongate member include a plurality of arm struts which are adapted to pivot or extend radially outward from the member to selectively anchor the device at a desired location within the line. Each of the arm struts are provided with a plurality of hot wire anemometers located at pre-determined positions along the length of the struts which yield a varying current signal in relation to the cooling rate of the anemometer in response to flow across the same. The arm struts are operated by an electric or hydraulic motor servo-mechanism which selectively extends the struts radially outward between a fully extended and fully contracted orientation. As such, the measuring device of the present invention may be lowered downward into the line, with the arm struts collapsed radially inward and once positioned at a desired location within the line, the arm struts may be extended radially outward to maintain the elongate member at a selected location within the line. Additionally, due to the anemometers being mounted to the struts at pre-determined locations, when maintained within the line, the anemometers provide signal data representing flow conditions at discrete regions or segments within the line. By monitoring the electric output from each of the anemometers, the flow within the line may be mathematically integrated and, thus determined.

The medial tubing segments of the flow meter device of the present invention house additional measuring instruments such as a temperature gauge, pressure gauge, and phase monitor which permit the output signals of the hot wire anemometers to be corrected or adjusted in response to other flow characteristics to insure accuracy in flow measurement results. Further, the medial tubing segments may house a battery source and data storage system which permits the hot wire anemometer flow meter device of the present invention to be maintained in a down hole application for extended periods of time to record and store the long term changes in flow characteristics within the well.

DESCRIPTION OF THE DRAWINGS

These as well as other features of the present invention will become more apparent upon reference to the drawings, wherein:

FIG. 1 is a cross-sectional view of a well line or casing extending through the overburden and into a mineral formation with the hot wire anemometer flow meter device of the present invention;

FIG. 2 is an enlarged partial cross-sectional view of the well line of FIG. 1 depicting the modular construction of the hot wire anemometer flow meter device of the present invention and illustrating the manner in which the same is anchored within the well line;

FIG. 3 is an enlarged partial perspective view illustrating the detailed construction of the plural arm struts and servo-mechanism utilized to extend and retract the arm struts from the hot wire anemometer flow meter device of the present invention;

FIG. 4 is a plan view of the upper arm struts of the hot wire anemometer flow meter device of the present invention depicting the position of the hot wire anemometers mounted thereon; and FIG. 5 is a plan view of the lower arm struts of the hot wire anemometer flow meter device of the present invention depicting the position of the hot wire anemometers mounted thereon.

DETAILED DESCRIPTION OF THE PREFERRED EMBODIMENT

Referring to FIG. 1, there is shown the hot wire anemometer flow meter device 10 of the present invention disposed within a flow conduit casing or line 12. As by way of example only, the line 12 comprises an oil or gas well line or casing which extends through the overburden 14 and into a mineral formation 16, such as an oil reservoir, gas reservoir or geothermally active area. However, those skilled in the art will recognize that the flow meter device 10 of the present invention may additionally be utilized in other flow measuring applications.

Referring more particularly to FIG. 2, it may be seen that the flow measuring device 10 of the present invention is preferably formed as an elongate tubular member composed of a plurality of tubing segments 20 through 34 which are interconnected as by way of intermeshing threads or aligned flanges (not shown) in a coaxial end-to-end orientation. In the preferred embodiment, the flow meter device 10 is formed having an overall length of approximately six feet and a maximum outside diameter of approximately one and eleven sixteenths inch which is suitable for typical small sized oil and gas line applications. However, the variations in these sizes may be easily made to accommodate the particular flow measurement application.

The uppermost end of the device 10 is provided with a suitable end coupling 41 which receives suspension cable or wire 42 extending upward to ground surface. As will be recognized, the cable 42 may additionally provide an electrical power source connection for the measuring device 10 as well as a conduit for relaying electrical signals obtained from the flow meter device 10 to ground surface. The lowermost end of the device 10 includes an end cap 44 which preferably includes a bullnose 46 to prevent damage to the device 10 and/or well line 12 during insertion of the device 10 within the well line 12.

The coupling 40 and end cap 44 are rigidly mounted to the tubing segments 20 and 34 respectively, both of which are provided with a plurality of arms or struts 50 adapted to extend radially outward from the tubing segments 20 and 34. Referring to FIGS. 3, 4, and 5, it will be seen that both the upper and lower tubing segments 20 and 34 respectively preferably include three arm struts 50, which are symmetrically spaced about the center line of the segments 20 and 34 but rotated 60 degrees with respect to one another such that the struts 50 of the upper tubing segment 20 do not circumferentially coincide with the struts 50 of the lower tubing segment 34. Each of the struts 50 are formed by a pair of spaced parallel elongate members 52 which are interconnected at opposite ends by a pair of cross-members 54. The uppermost cross-members 54 are pivotally mounted to the tubing segments 20 and 34 by suitable pins or bearing 56, and the struts 50 are each sized to be received within a respective complimentary shaped elongate aperture 60 formed in the tubing segments 20 and 34.

Each of the arm struts 50 includes a linkage 62 which is pivotally mounted at one end to the medial portion of the arm members 50 and at the opposite end to a common sleeve or transmission disk 64 disposed within the interior of the tubing segments 20 and 34. As best shown in FIG. 3, the sleeve 64 threadingly communicates with a lead screw 66 which is driven by a suitable hydraulic or electrical motor 68 mounted within the interior of the tubing segments 20 and 34.

By such a structure, it will be recognized that rotation of the motor 68 causes a corresponding rotation of lead screws 66, which is effective in transporting the sleeves 64 vertically along the length of the lead screws 66. Due to the interaction of the linkages 62 with the sleeves 64 and each of the struts 50, during this axial transport of the sleeves 64, the arm struts 50 pivotally extend radially outward from their fully retracted position (i.e. disposed within the elongate apertures 60) to a fully extended position (i.e. indicated by the phantom lines in FIGS. 2 and 3).

A plurality of hot wire anemometers 70 are mounted to each of the struts 50 and extend in a generally normal direction to the parallel arm members 52 of the struts 50. Such hot wire anemometers are well known in the art and generate a varying electrical output signal in response to the cooling rate of the same caused by fluid flowing across the anemometers. In the preferred embodiment, two anemometers 70 are mounted on each of the respective arm struts 50; however, additional anemometers may be mounted thereon at predetermined locational intervals along the length of the struts 50 to provide suitable data collection locations. In addition to the plural anemometers 70, the struts 50 each mount a flow direction indicator 71 (shown in FIG. 3) which in the preferred embodiment, comprises a simple weather vane-like or paddle wheel-like mechanism adapted to rotate in either a clockwise, counterclockwise direction, or remain stationary dependent upon the flow direction across the struts 50. However, those skilled in the art will recognize that alternative direction indicators can be utilized for indicating flow direction.

Referring again to FIG. 2, it may be seen that the tubing segments 20 and 34 are rigidly mounted to the tubing segments 22 and 32, respectively, which in the preferred embodiment comprise a battery source adapted to provide power to the electric or hydraulic motors 68 in the tubing segments 20 and 34. In those instances, however, where electrical power is supplied through the cable or wire 42 the battery sections 22 and 32 may, of course, be eliminated from the composite flow meter device 10. The sections 24, 26, 28 and 30 are disposed between the battery sections 22 and 32 and, hence, form the medial portion of the flow meter device 10. The tubing segments 26 and 28 comprise conventional pressure and temperature gauges respectively, while the tubing segment 30 houses a phase monitor adapted to determine the proportionate amount of water, oil and gas within the well line 12. Such phase monitors are well known in the art and typically comprise the capacitance measuring device which electrically analyzes a test sample of fluid from the line 12.

In the preferred embodiment, the tubing segment 24 comprises a common connecting section wherein the various electrical connections from the separate tubing segments 20, 22, 26, 28, 30, 32, and 34 may be facilitated. In addition, the section preferably includes a suitable microprocessor (not shown) and data storage means (not shown) which permits the numerical tabulation of and/or storage of data received from the separate tubing segments 20 through 34.

With the structure defined, the operation of the hot wire anemometer flow meter device 10 of the present invention may be described. Initially, the plural struts 50 must be positioned in their fully retracted position (i.e. wherein they reside within the respective elongate apertures 60 formed in the tubing segments 20 and 34) and the entire measuring device 10 may be lowered downward into the line 12. When lowered to a desired location, the motors 68 mounted within the interior of the tubing segments 20 and 34 may be activated causing the plural struts 50 to extend from their retracted position radially outward to their fully extended position to contact the line wall 12 as indicated by the phantom lines in FIG. 2. As will be recognized, in their extended position, the struts 50 anchor the device 10 in a desired location within the line 12 and additionally self-axially register the device 10 in a coaxial orientation within the line 12. In addition, it will be noted that the plural anemometers 70 and direction indicators 71 positioned upon the struts 50 are disposed at differing radial locations within the casing 12 and, hence, provide data representing the flow through the line 12 at predetermined axial spacing from the center line of the flow line 12 as well as in discrete radian sections corresponding to localized cross-sectional flow regions within the conduit or line 12.

By monitoring the electrical output signal from each of the anemometers 70 and obtaining the flow direction by way of the directional indicators 71, flow data at multiple or discrete radian sections within the line 12 may be obtained. Further, by knowing the temperature pressure, and water, gas and oil ratio or percentage of the fluid from the data received from the pressure gauge 26, temperature gauge 28, and phase monitor 30, the total flow rate within the line 12 may be numerically calculated by mathematical integration of flow data obtained in each of the discrete radian sections within the line; which in the preferred embodiment, is accomplished as by way of a microprocessor (not shown) disposed within the tubing segment 24. In those instances where flow within the line 12 is desired to be constantly determined, the various data signals may be communicated to ground surface via the cable 42, while in those instances where long term flow characteristics are desired, the data may be stored within the electronic storage apparatus in the tubing segment 24 for later review.

Thus, in summary, the present invention provides a significant improvement in the art by providing a flow meter device which yields accurate data in both laminar and turbulent flow conditions, as well as in both single, dual and triple phase flow applications. Although in the preferred embodiment, specific materials and/or sizes are specified, variations in the same may be readily made without departing from the spirit of the present invention and such variations are contemplated herein.

What is claimed is:

1. An improved flow meter device for measuring flow through a conduit comprising:

an elongate member sized to be received within a flow conduit;

plural struts pivotally mounted to said elongate member extensible radially outward from said elongate member to contact said flow conduit and anchor said elongate member at a desired location within said flow conduit;

means for selectively radially extending and retracting said plural struts from said elongate member; and plural anemometers mounted along the length of struts for generating a variable electrical signal in response to the amount of flow medium passing across said anemometers.

2. The flow meter device of claim 1 wherein said plural struts are symmetrically spaced about said elongate member to axially register said elongate member within said flow conduit when said plural struts are extended radially to contact said flow conduit.

3. The flow meter device of claim 2 wherein said plural struts each comprise a pair of spaced generally parallel members pivotally mounted at one end to said elongate member.

4. The flow meter device of claim 3 wherein said plural anemometers are mounted to said struts to extend between said pair of spaced generally parallel member.

5. The flow meter device of claim 4 wherein said extending means comprises a motor mounted within the interior of said elongate member and cooperating with linkage means attached to said plural struts.

6. The flow meter device of claim 5 further comprising a temperature gauge positioned on said elongate member to determine the temperature of the flow medium adjacent said anemometers.

7. The flow meter device of claim 6 further comprising a pressure gauge positioned on said elongate member to determine the pressure of the flow medium adjacent said anemometers.

8. The flow meter device of claim 7 further comprising means mounted to said elongate member for determining the phase constituents within the flow medium adjacent said anemometers.

9. The flow meter device of claim 8 wherein said plural struts are positioned adjacent opposite ends said elongate member.

10. An improved flow meter device for accurately measuring flow in a conduit extending from ground surface into a mineral resevoir comprising:

an elongate tubular member sized to be received within and lowered from ground surface to a desired elevation within said conduit;

plural struts mounted to said elongate tubular member for movement between a retracted position wherein said struts are maintained in a plane generally parallel to the axis of said tubular member and an extended position wherein said struts are maintained in a plane angularly disposed to the axis of said tubular member to contact said conduit and anchor said elongate tubular member at said desired elevation;

means for selectively driving said plural struts between said retracted and extended positions;

plural hot-wire anemometers means mounted along the length of said plural struts for generating an electrical signal representing the amount of flow passing across said anemometer means and through said conduit;

carried by said elongate tubular member means for measuring the temperature of flow passing across said anemometer means; and carried by said elongate tubular member means for measuring the pressure of flow passing across said anemometer means.

11. The flow meter device of claim 10 wherein said elongate tubular member is formed of a plurality of individual tubing segments connected in an end-to-end orientation and said driving means, temperature measuring means and said pressure measuring means are each housed in separate ones of said individual tubing segments.

12. A method of accurately determining flow within a conduit comprising the steps of:

positioning a plurality of hot wire anemometers at discrete radian sections within said conduit, said anemometers adapted to generate a variable electric signal in response to the amount of flow passing across said anemometers;

positioning within said conduit means for detecting the direction of flow within each of said discrete radian sections;

monitoring the electric signals generated by each of said plural anemometers and said detecting means to obtain data representing the flow within each of said discrete radian sections; and mathematically integrating said data obtained from each of said discrete radian sections to determine the total flow rate within said conduit.

13. The method of claim 12 comprising the further step of measuring the temperature and pressure of flow within at least one of said discrete radian sections within said conduit.

14. The method of claim 12 further comprising the step of storing said data representing flow within each of said discrete radian sections.

* * * * *